US009435592B2

(12) United States Patent
Curry

(10) Patent No.: US 9,435,592 B2
(45) Date of Patent: Sep. 6, 2016

(54) FIREARM HAVING SLIDE STOP SUPPORT MECHANISM

(71) Applicant: Smith & Wesson Corp., Springfield, MA (US)

(72) Inventor: Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/949,201

(22) Filed: Nov. 23, 2015

(65) Prior Publication Data

US 2016/0076833 A1 Mar. 17, 2016

Related U.S. Application Data

(62) Division of application No. 14/230,302, filed on Mar. 31, 2014, now Pat. No. 9,207,032.

(60) Provisional application No. 61/888,711, filed on Oct. 9, 2013.

(51) Int. Cl.

| | |
|---|---|
| ***F41A 3/78*** | (2006.01) |
| ***F41A 11/00*** | (2006.01) |
| ***F41A 3/68*** | (2006.01) |
| ***F41A 17/36*** | (2006.01) |
| ***F41C 3/00*** | (2006.01) |

(52) U.S. Cl.
CPC ..... *F41A 3/68* (2013.01); *F41A 17/36* (2013.01); *F41C 3/00* (2013.01)

(58) Field of Classification Search
USPC ..... 42/16, 34, 38, 69.02; 89/145, 162, 164
See application file for complete search history.

(56) References Cited

U.S. PATENT DOCUMENTS

| | | | | |
|---|---|---|---|---|
| 3,745,881 | A | 7/1973 | Roy | |
| 4,176,584 | A | 12/1979 | Thomas, Jr. et al. | |
| 4,358,987 | A | 11/1982 | Wilhelm | |
| 4,361,975 | A * | 12/1982 | Wilhelm | F41A 19/48 42/69.01 |
| 4,549,465 | A | 10/1985 | Charron | |
| 4,577,430 | A * | 3/1986 | Ruger | F41A 19/10 42/69.01 |
| 4,777,754 | A * | 10/1988 | Reynolds, Jr. | F41G 1/345 362/110 |
| 4,856,218 | A * | 8/1989 | Reynolds, Jr. | F41G 1/345 362/110 |
| 5,519,954 | A * | 5/1996 | Garrett | F41A 35/06 42/6 |
| 7,103,998 | B2 | 9/2006 | McGarry | |
| 7,337,570 | B1 | 3/2008 | McGarry | |
| 7,337,571 | B2 | 3/2008 | McGarry | |
| 7,343,706 | B2 | 3/2008 | McGarry | |
| 7,562,482 | B1 * | 7/2009 | Johnson | F42B 39/02 42/50 |
| 7,661,219 | B1 * | 2/2010 | Knight, Jr. | F41A 3/42 42/17 |

(Continued)

*Primary Examiner* — Michael David
(74) *Attorney, Agent, or Firm* — John A. Chionchio, Esq.; Ballard Spahr LLP

(57) ABSTRACT

To prevent inertial forces from inadvertently releasing the slide of a semi-automatic pistol into battery, a slide stop retention mechanism is mounted on the frame. A finger extends from the mechanism and pivots under the force of a biasing spring into engagement with the slide stop when the slide is in the open position. The finger supports the slide stop. A force applied to the slide stop, either manually or via a cam on the slide when the slide is pulled back and released, will move the finger out of its supporting position and allow the slide to move to battery.

3 Claims, 6 Drawing Sheets

(56) References Cited

U.S. PATENT DOCUMENTS

| | | | | |
|---|---|---|---|---|
| 7,694,449 | B1 * | 4/2010 | Pontillo, II | F41A 3/26 42/71.02 |
| 7,971,379 | B2 * | 7/2011 | Robinson | F41A 3/26 42/7 |
| 8,006,609 | B2 | 8/2011 | Kallio et al. | |
| 8,683,725 | B2 * | 4/2014 | Munson | F41A 17/38 42/6 |
| 8,756,843 | B1 * | 6/2014 | Cantrell | F41A 3/10 42/49.01 |
| 8,950,100 | B2 * | 2/2015 | Nebeker | 29/426.1 |
| 2009/0001117 | A1 * | 1/2009 | Rassias | F41C 33/0236 224/673 |
| 2010/0281735 | A1 | 11/2010 | Kallio et al. | |
| 2012/0192474 | A1 | 8/2012 | Pratt | |
| 2015/0096212 | A1 * | 4/2015 | Curry | F41A 17/36 42/16 |

* cited by examiner

FIREARM HAVING SLIDE STOP SUPPORT MECHANISM

CROSS REFERENCE TO RELATED APPLICATIONS

This application is a divisional of U.S. application Ser. No. 14/230,302 filed Mar. 31, 2014, which is based upon and claims priority to U.S. Provisional Patent Application No. 61/888,711 filed Oct. 9, 2013 and hereby incorporated by reference herein.

FIELD OF THE INVENTION

This invention relates to slide stops used in semi-automatic pistols.

BACKGROUND

Modern Semi-automatic pistols having a reciprocating slide mounted atop a frame typically have a slide stop mounted on the frame which works in conjunction with the slide to hold it in an open position after the last round is discharged. Such slide stops are often biased away from the slide and only engage the slide when they are forced into engagement by the follower of the magazine, which has a pawl that engages the slide stop. The slide stop engages a catch in the slide to hold it in the open position.

When an empty magazine is replaced by a full magazine the pawl of the follower of the full magazine does not engage the slide stop. The slide stop is held in engagement with the slide against its biasing force by friction between it and the surfaces of the catch which it engages, as well as the geometry of the interfacing surfaces, which can provide varying degrees of mechanical engagement. The slide may be returned to battery by disengaging the slide stop from the catch. A return spring within the frame then operates on the slide to move it into battery, stripping a round from the magazine and chambering the round. Intentional disengagement of the slide stop may be effected by drawing the slide back, thereby disengaging the slide stop from the catch which allows the slide stop to move away from the slide under its biasing force. The slide is then released and moves into battery under the force of the return spring. Another method of returning the slide to battery is to directly push the slide stop away from the slide, forcibly disengaging the slide stop from the catch. The slide will then move to battery under the force of the return spring.

It is desirable to avoid unintentional disengagement of the slide stop from the slide which allows the slide to unexpectedly move into battery. This may occur, for example, when a magazine is forcefully driven home into the magazine well of the pistol. The inertial forces of that action, combined with the biasing force on the slide stop, can sometimes overcome the friction between the slide stop and the catch and cause the slide stop to move away from the slide and thereby release the slide, which moves into battery. There are clear advantages to preventing such an occurrence.

SUMMARY

The invention concerns a retention mechanism for holding a slide stop of a pistol in engagement with a slide. In one example embodiment, the mechanism comprises a housing having a base for mounting the housing on the pistol. A body is movably mounted on the housing. A spring is positioned within the housing for biasing the body to a position away from the base for engagement of the body with the slide stop so as to hold the slide stop in a position of engagement with the slide. The body is movable toward the base to release the slide stop and permit disengagement of the slide stop from the slide.

In a particular example embodiment, the spring comprises a coil spring. In a further embodiment, the housing comprises a back wall extending transversely to the base. A sidewall is arranged contiguous with the back wall. The sidewall extends substantially parallel to the base. A cavity is positioned within the sidewall in spaced relation away from the back wall. In this example the body comprises a finger having a first end positioned adjacent to the cavity and a second end extending outwardly from the housing. A lobe is mounted on the first end of the finger and extends transversely thereto. The lobe is received within the cavity. The coil spring acts between the back wall and the first end of the finger to bias the finger angularly away from the base.

In a particular example embodiment, the finger comprises a contact surface on the second end thereof. The contact surface is angularly oriented relatively to the base.

The invention also encompasses a pistol. In an example embodiment, the pistol comprises a frame. A slide is mounted on the frame. The slide is reciprocably movable relatively to the frame between an open position and a battery position. A catch is positioned in the slide. A slide stop is movably mounted on the frame. The slide stop is movable into engagement with the catch to hold the slide in the open position. The slide stop is movable out of engagement with the catch to release the slide for movement into the battery position. A housing is mounted on the frame adjacent to the slide stop. A body is movably mounted on the housing. The body is movable toward the slide stop for holding the slide stop in engagement with the catch in the slide. The body is also movable away from the slide stop to permit release of the slide stop from engagement with the catch. A spring is positioned within the housing for biasing the body toward the slide stop.

In a particular example embodiment, the spring comprises a coil spring.

By way of example the housing comprises a back wall extending transversely to the frame. A sidewall is contiguous with the back wall and extends substantially parallel to the frame. A cavity is positioned within the sidewall in spaced relation away from the back wall. In this example embodiment the body comprises a finger having a first end positioned adjacent to the cavity and a second end extending outwardly from the housing. A lobe is mounted on the first end of the finger and extends transversely thereto. The lobe is received within the cavity. The coil spring acts between the back wall and the first end of the finger to bias the finger angularly away from the frame.

In a particular example embodiment, the finger has a contact surface on the second end thereof. The contact surface is angularly oriented relatively to the frame. The contact surface engages the slide stop when the finger is biased angularly away from the frame.

DETAILED DESCRIPTION

Figure 1:
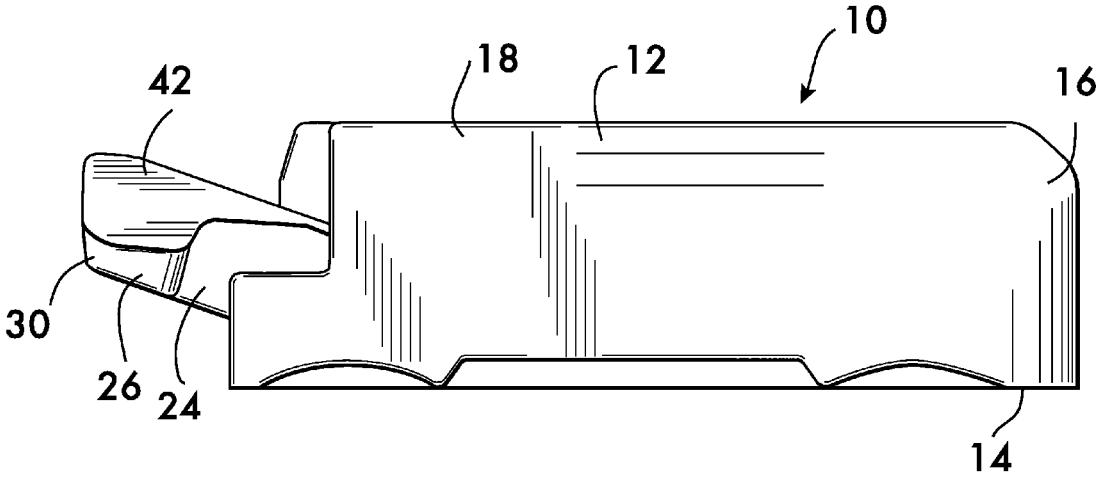
FIG. 1 is a top view of an example embodiment of a slide stop retention mechanism according to the invention.
Figure 2:
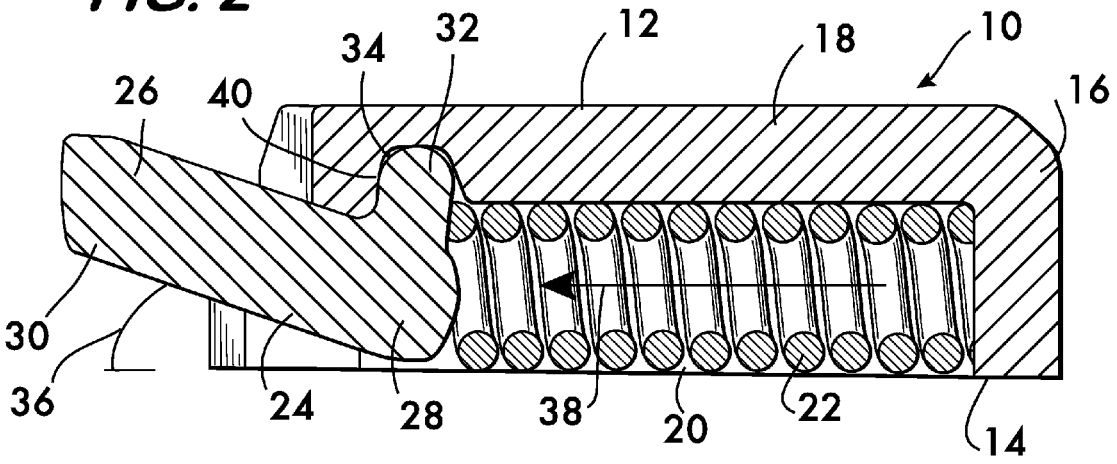
FIG. 2 is a longitudinal sectional view of the slide stop retention mechanism shown in FIG. 1.

FIGS. 1 and 2 show an example embodiment of a slide stop retention mechanism 10 according to the invention. Mechanism 10 comprises a housing 12. Housing 12 has a base 14 facilitating mounting of the housing to a pistol. Base 14 need not entirely enclose housing 14, but may, as in this example, merely comprise a surface that interfaces with the frame of a pistol. Further in this example, the housing comprises a back wall 16 extending transversely to the base, and a sidewall 18, contiguous with the back wall 16 and extending substantially parallel to the base 14. The back and sidewalls define a chamber 20 that receives a spring 22 and a body 24. As shown in this example, spring 22 is a coil spring. Body 24 comprises a finger 26 having a first end 28 located within the chamber 20 and a second end 30 extending outwardly from the housing 12. A lobe 32 is mounted on the first end of the finger 26. The lobe 32 extends transversely to the finger 26 and is received within a cavity 34 positioned within the sidewall 18 in spaced relation away from back wall 16. Finger 26 is movable relatively to housing 12, in this example, the finger is pivotably movable through an angle 36 as measured relatively to base 14. Pivoting motion of the finger is permitted by the rounded shape of the lobe 32 which allows the lobe to rotate within the cavity 34.

Spring 22 acts between the back wall 16 and the first end 28 of the finger 26, the first end being positioned adjacent to the cavity 34. Due to the eccentricity between the line of action 38 of spring 22 and the reaction point 40 between the lobe 32 and the sidewall 18 within the cavity 34, the finger 26 is biased by the spring 22 into a position angularly away from the base 14. The finger 26 is movable relatively to the housing 12 through the angle 36 in a direction substantially perpendicular to the base 14 of the housing 12. The finger 26 is movable against the biasing force of spring 22 toward the base 14 by the application of an external force, the finger returning to an angular position away from the base 14 upon removal of the external force. As shown in FIG. 1, a contact surface 42 is positioned on the second end 30 of the finger 26. Contact surface 42 is angularly oriented relatively to the base 14 for reasons described in detail below.

Figure 3:
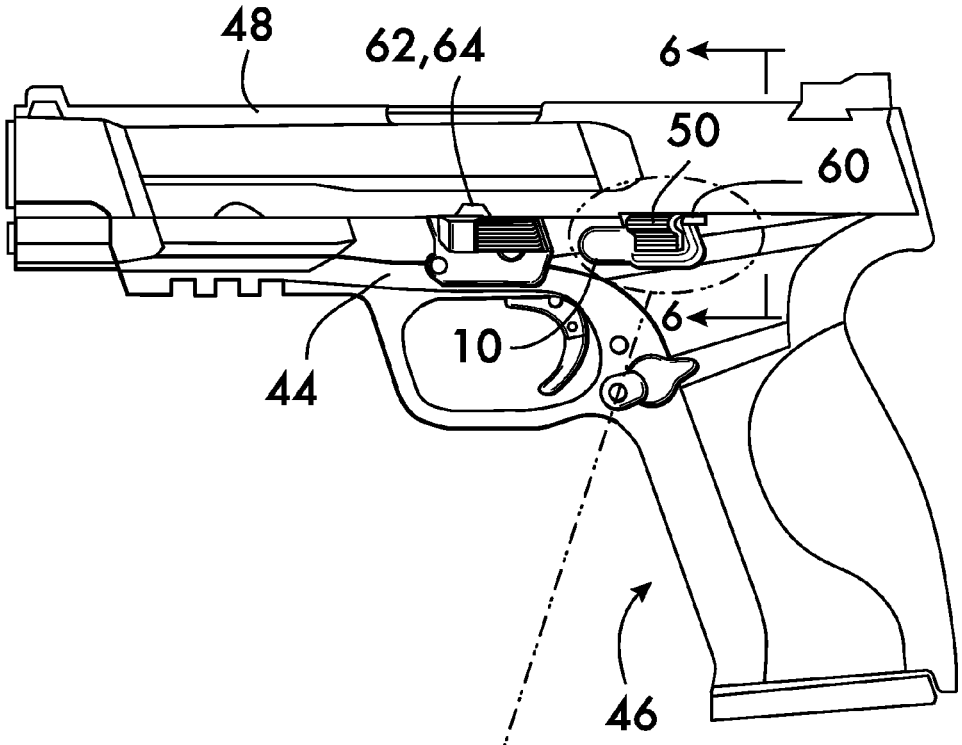
FIG. 3 is a side view of a semi-automatic pistol in battery using the slide stop retention mechanism shown in FIG. 1.
Figure 3A:
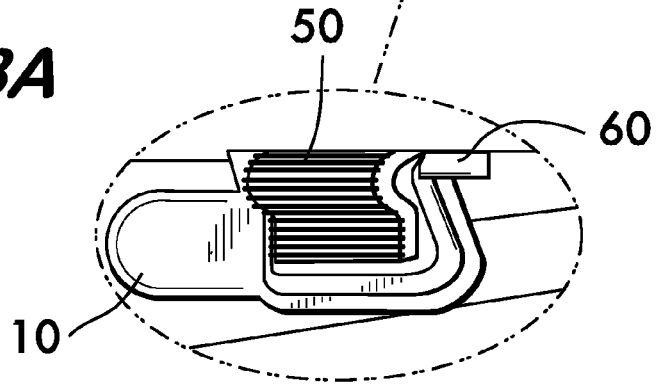
FIG. 3A is a side view of a portion of the pistol of FIG. 3 showing the slide stop retention mechanism on an enlarged scale.
Figure 4:
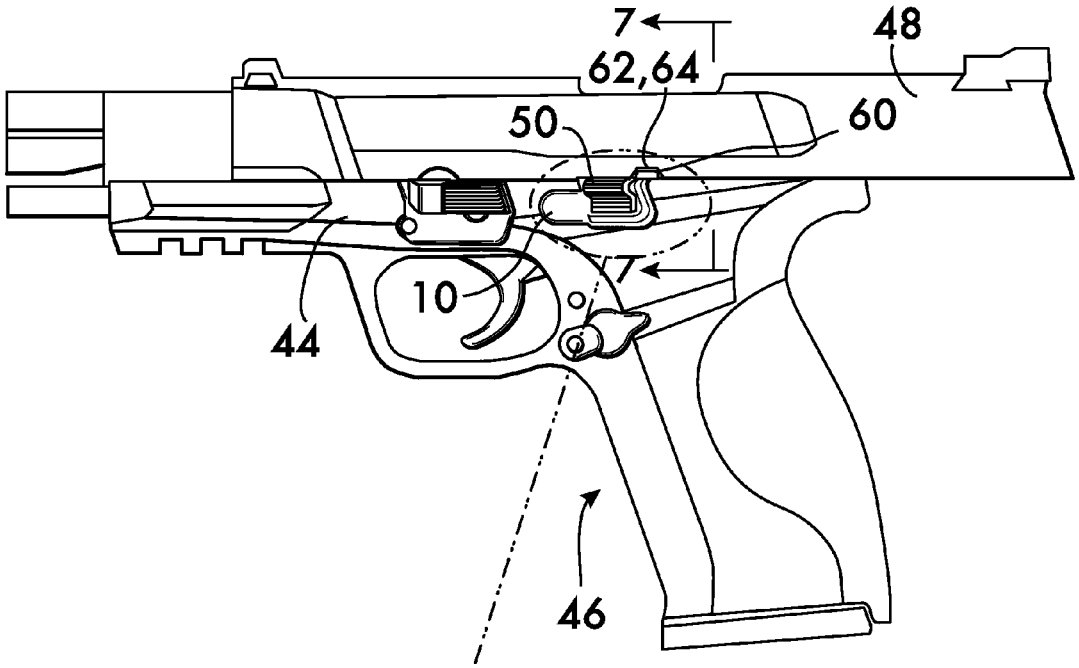
FIG. 4 is a side view of the semi-automatic pistol shown in FIG. 3 in open configuration.
Figure 4A:
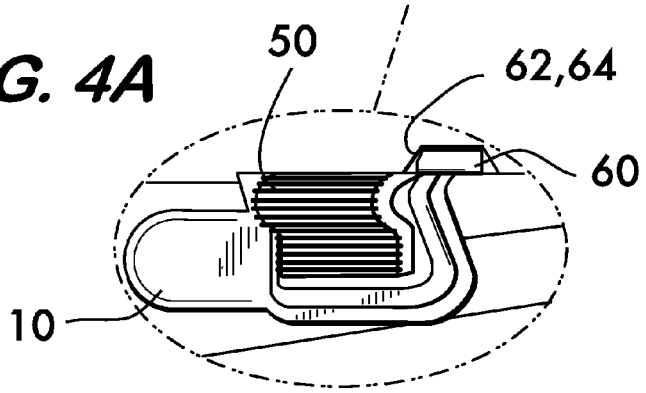
FIG. 4A is a side view of a portion of the pistol of FIG. 4 showing the slide stop retention mechanism on an enlarged scale.
Figure 5:
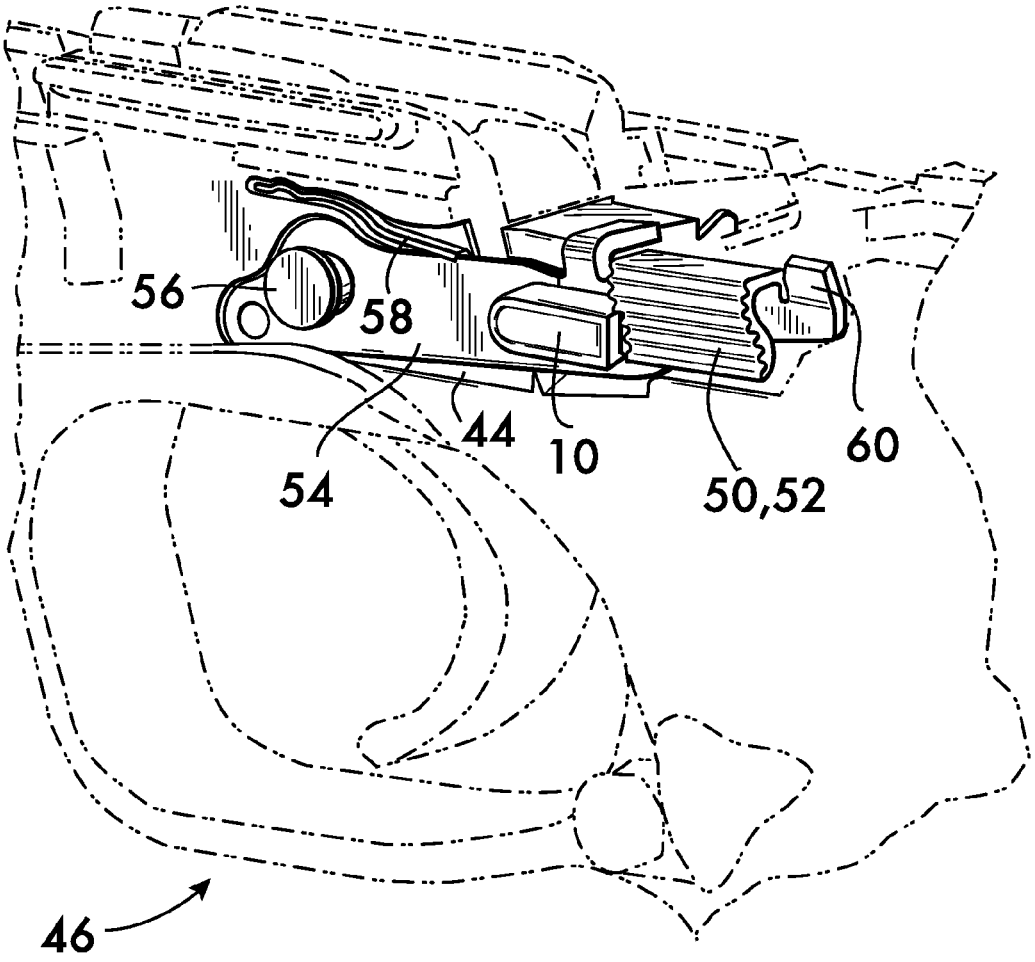
FIG. 5 is a partial isometric view of a portion of the pistol shown in FIGS. 3 and 4.

FIGS. 3 and 4 show the mechanism 10 mounted on the frame 44 of a semi-automatic pistol 46. Pistol 46 has a slide 48 mounted on frame 44. Slide 48 is reciprocably movable lengthwise along the frame between a battery position (FIG. 3) and an open position (FIG. 4). As shown in detail in FIGS. 3A and 4A, a slide stop 50 is mounted on the frame 44. Mechanism 10 is positioned adjacent to the slide stop 50 so that finger 26 can engage it. As shown in FIG. 5, slide stop 50 comprises a manual actuation pad 52 positioned at the end of a lever 54 that is pivotably mounted on frame 44 by a pivot pin 56. Slide stop 50 is thus pivotably movable about pivot pin 56 toward and away from the slide 48. A spring 58 acts between the frame 44 and the lever 54 to bias the slide stop away from the slide 48. Slide stop 50 also comprises a tab 60 positioned adjacent to the actuation pad 52. Tab 60 projects toward the slide 48. When the slide stop 50 is pivoted toward the slide 48 the tab 60 is moved to a position where it can engage a catch 62 in slide 48 (compare FIGS. 3 and 4) to hold the slide 48 in the open position. In this example the catch 62 comprises a notch 64 positioned in the slide 48, the notch 64 and tab 60 being shaped so as to cooperate and hold the slide 48 open against the force of a return spring (not shown) which drives the slide into battery during action cycling. When slide stop 50 is pivoted away from the slide 48, the tab 60 disengages from the catch (notch 64) and permits the slide to move from the open position (FIG. 4) into battery (FIG. 3) under the force of the return spring (not shown).

Figure 6:
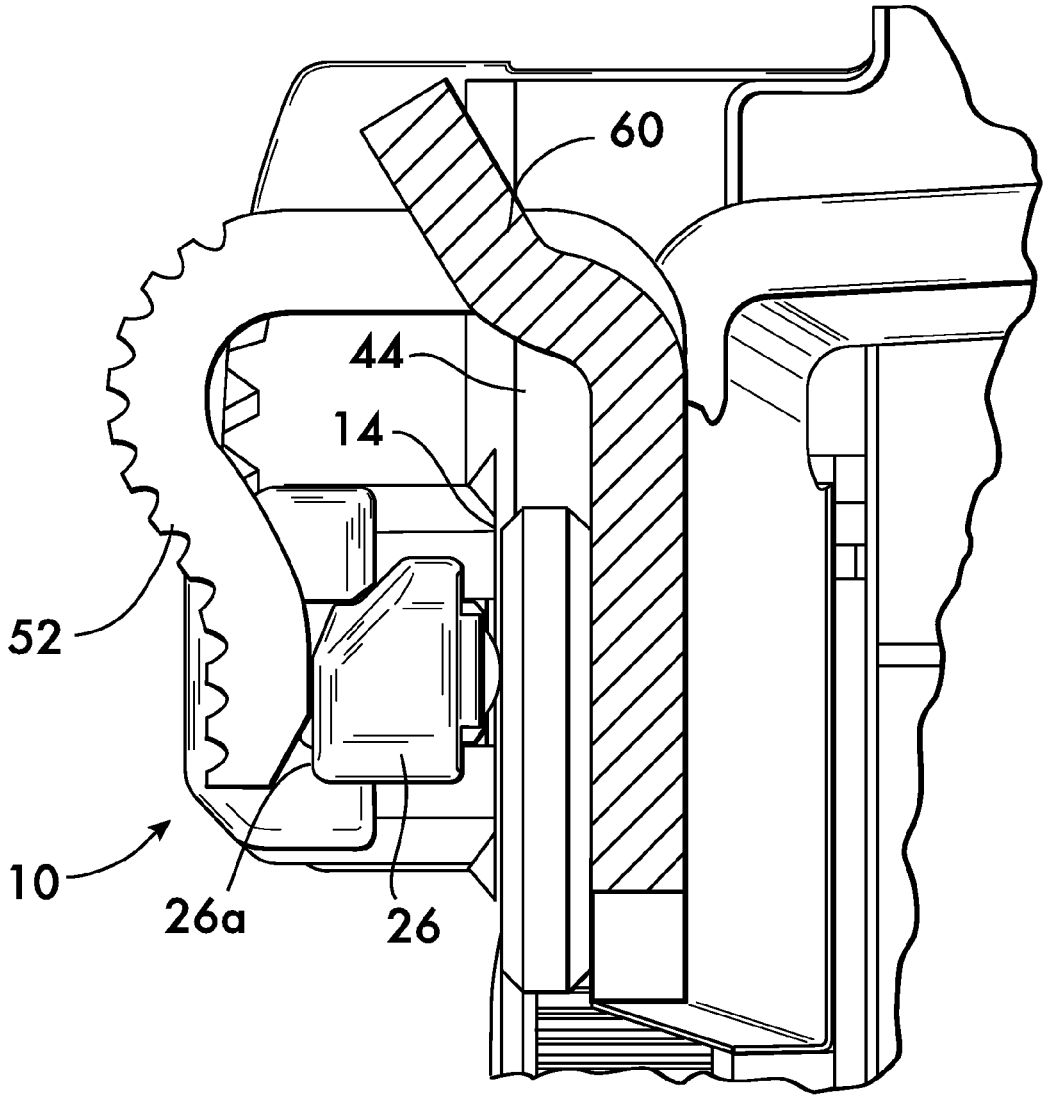
FIGS. 6 and 7 are cross sectional views taken respectively at lines 6-6 and 7-7 of FIGS. 3 and 4.
Figure 7:
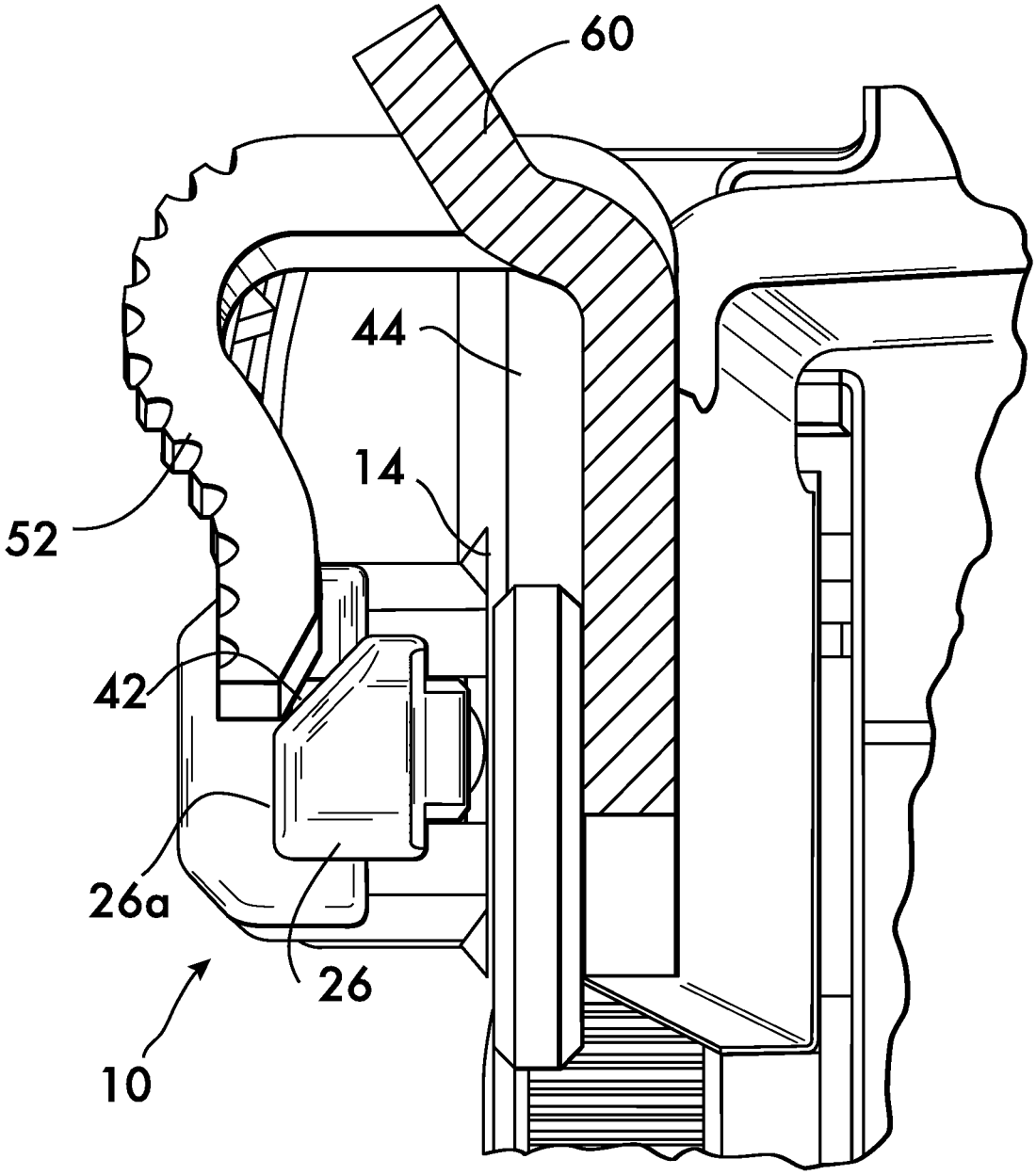

With reference to FIG. 5, under the action of spring 58, the slide stop 50 is biased into a position away from the slide 48 and thus does not interfere with the reciprocal motion of slide during firing. This position of the actuation pad 52 and the tab 60 during firing is shown in FIG. 6. Note that a face 26*a* of the finger 26 is in contact with the back side of the actuation pad 52. As explained above, the spring 22 (see FIG. 2) biases the finger away from the base 14 and toward the actuation pad 52. However, when the last round from a magazine (not shown) is discharged, a pawl on the magazine follower (not shown) engages the slide stop 50 and pivots it against its biasing spring 58 and toward the slide 48 so that tab 60 engages notch 64 on the slide to hold it in the open position (FIG. 3). This position of the slide stop 50 as represented by actuation pad 52 is shown in FIG. 7. In comparison with FIG. 6, note that the actuation pad 52 and the tab 60 have moved upwardly in FIG. 7, thereby moving the actuation pad 52 off of face 26*a* and in alignment with the angularly oriented contact surface 42. Under the biasing force of spring 22 (FIG. 2) the finger 26 pivots away from the frame 44 as shown in FIG. 7, and the contact surface 42 engages the actuation pad 52 of the slide stop 50 and supports the slide stop against its biasing spring 58 in the position with tab 60 engaged with notch 64 (see also FIG. 3).

When the empty magazine is replaced by a full magazine, the pawl of the magazine follower is no longer engaged with the slide stop 50. Continued engagement between the slide stop 50 and the catch 62 on the slide 48 depends upon: 1) friction between the interfacing surfaces of the tab 60 and the notch 64; 2) the geometry of those surfaces; 3) friction between the contact surface 42 and the actuation pad 52; and 4) the geometry of those surfaces. Note that the angled orientation of contact surface 42, when pressed against the actuation pad 52 by its spring 22, applies an upward force (toward the slide) to the slide stop 50. The additional factors 3 and 4 above attributable to the slide stop retention mechanism 10 help prevent an inertial force, such as might be experienced when a full magazine is forcefully driven home into the magazine well of the pistol, from jarring the tab 60 of slide stop 50 out of engagement with the catch 62 (notch 64) and thereby inadvertently releasing the slide 48.

The mechanism 10 thus helps maintain engagement between the slide stop 50 and the catch 62 on slide 48 to keep the slide in the open position despite the inertial loads. However, when it is desired to permit the slide to move into battery position, the biasing force of the spring 22 may be overcome and the finger 26 pivoted back into the position shown in FIG. 6 by manually applying a force to the slide stop 50 in a direction away from the slide 48 (downwardly in FIG. 7). The angled contact surface 42 of finger 26 in contact with the actuation pad 52 of the slide stop 50 generates a resultant force moving the finger toward its base 14 and the frame 44, and in a direction away from the slide stop 50 when the force is applied to the slide stop. The actuation pad 52 of slide stop 50 and the finger 26 assume the configuration shown in FIG. 6, where the finger 26 is behind the actuation pad 52 and no longer provides support to the slide stop 50. The slide stop is thus free to disengage from the catch 62 and allow the slide 26 to move to the battery position. The slide stop 50 may also be disengaged from the catch by drawing the slide 48 back and then releasing it. A cam (not shown) on the slide engages the slide stop 50 and pushes it away from the slide. The cam action overcomes the spring bias of the spring 22 and moves the finger 26 into the position shown in FIG. 6 while also allowing the slide stop 50 to pivot out of engagement with the slide 48. The slide 48 is thus free to move into battery under its return spring as shown in FIG. 3.

What is claimed is:

1. A pistol, comprising:

a frame;

a slide mounted on said frame, said slide being reciprocably movable relatively to said frame between an open position and a battery position;

a catch positioned in said slide;

a slide stop movably mounted on said frame, said slide stop being movable into engagement with said catch to hold said slide in said open position, said slide stop being movable out of engagement with said catch to release said slide for movement into said battery position;

a housing having a base for mounting said housing on said pistol, a back wall extending transversely to said base, a sidewall contiguous with said back wall extending substantially parallel to said base, a cavity positioned within said sidewall in spaced relation away from said back wall;

a body movably mounted on said housing, said body comprising a finger having a first end positioned adjacent to said cavity and a second end extending outwardly from said housing, a lobe mounted on said first end of said finger extending transversely thereto, said lobe being received within said cavity;

a spring positioned within said housing acting between said back wall and said first end of said finger for biasing said body to a position angularly away from said base for engagement of said body with said slide stop so as to hold said slide stop in a position of engagement with said slide, said body being movable toward said base to release said slide stop and permit disengagement of said slide stop from said slide.

2. The pistol according to claim 1, wherein said spring comprises a coil spring.

3. The pistol according to claim 1, wherein said finger has a contact surface on said second end thereof, said contact surface being angularly oriented relatively to said frame, said contact surface engaging said slide stop when said finger is biased angularly away from said frame.

* * * * *